United States Patent [19]

Galin

[11] 3,948,380

[45] Apr. 6, 1976

[54] COIN OPERATED VENDING MACHINE

[75] Inventor: Harry Galin, Willow Grove, Pa.

[73] Assignee: Wm. Wrigley, Jr. Company, Chicago, Ill.

[22] Filed: May 29, 1974

[21] Appl. No.: 474,467

[52] U.S. Cl. ..... 194/57; 194/DIG. 2

[51] Int. Cl.[2] ..... G07F 5/06

[58] Field of Search ..... 194/58, 57, 1 G, DIG. 2, 194/69; 221/125

[56] References Cited

UNITED STATES PATENTS

| | | | |
|---|---|---|---|
| 1,656,752 | 1/1928 | Naunton | 194/58 |
| 2,365,257 | 12/1944 | Emerson et al. | 194/58 |
| 2,681,842 | 6/1954 | Rabkin et al. | 194/58 X |
| 3,044,598 | 7/1962 | Hill | 194/58 X |
| 3,666,068 | 5/1972 | Kenny | 194/58 |

*Primary Examiner*—Robert B. Reeves
*Assistant Examiner*—Francis J. Bartuska
*Attorney, Agent, or Firm*—Seidel, Gonda & Goldhammer

[57] ABSTRACT

The dispensing device of a vending machine is provided with a coin operated latch. The latch assumes an inoperative position wherein it does not block the dispensing device in response to contact with a proper coin. When a dispensing action occurs, the dispensing device causes the coin to move the latch to said inoperative position and also directs the coin to a receptacle.

10 Claims, 7 Drawing Figures

COIN OPERATED VENDING MACHINE

BRIEF SUMMARY OF THE INVENTION

This invention is directed to a coin operated vending machine. As used herein, the word "coin" embraces legal tender such as quarters, nickels and dimes as well as non-legal tender in the form of tokens. The specific nature of the article being dispensed forms no part of the invention.

The vending machine for the present invention includes a housing having a movable actuator. The actuator is operatively associated with a dispensing device. A latch is associated with the dispensing device. The latch is biased to a first position wherein it blocks said dispensing device and has a second position wherein the latch does not block said dispensing device.

The latch has surfaces which are moved by contact with a coin so that the latch assumes its second position. The dispensing device has at least one guide surface for contact with a portion of the latch when the latch is in its second position. A means associated with the dispensing device is provided for causing a coin to move from the latch to a receptacle when a dispensing action occurs.

In a specific embodiment of the present invention each latch includes a pair of latching fingers which embrace oppositely disposed peripheral portions of a coin. The dispensing device includes a surface which moves between the latching fingers when a dispensing action occurs to physically contact the coin and move it from a position wherein it is embraced by said latching fingers to a position wherein it is received in a receptacle.

The specific embodiment of the present invention may have a plurality of latches each adapted to receive different coins whereby a predetermined number of specific coins must be present at the latches in order to permit a dispensing action to occur. Further, at least one of the latches may be selectively rendered inoperative to thereby permit selectivity in the number or value of coins needed to permit a dispensing action to occur.

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

Figure 1:
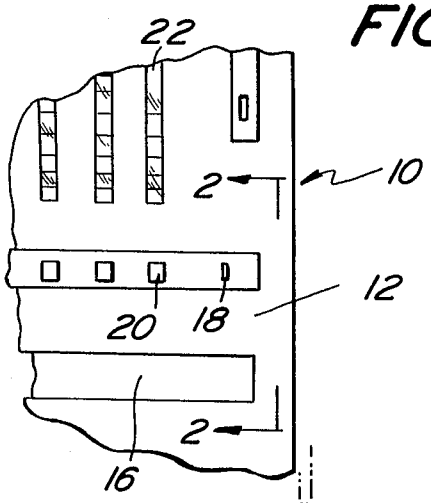
FIG. 1 is a partial front elevation view of a machine in accordance with the present invention.

Referring to the drawing in detail, wherein like numerals indiciate like elements, there is shown in FIG. 1 a portion of the front of a vending machine designated generally as 10. The machine 10 is adapted to contain rows of the same or different articles to be dispensed. The specific nature of the articles to be dispensed forms no part of the present invention. For the purposes of this disclosure, the articles may be considered packages of chewing gum, candy, etc.

The vending machine 10 includes a housing having front wall 12, rear wall 14, and side wall 15. The front wall 12 includes a recess 16 from which the articles may be retrieved. Above the recess 16, there is provided on the housing a coin return member 18 and a plurality of actuators 20. Each actuator is associated with a column of articles 22 which may be visible through a window.

Figure 4:
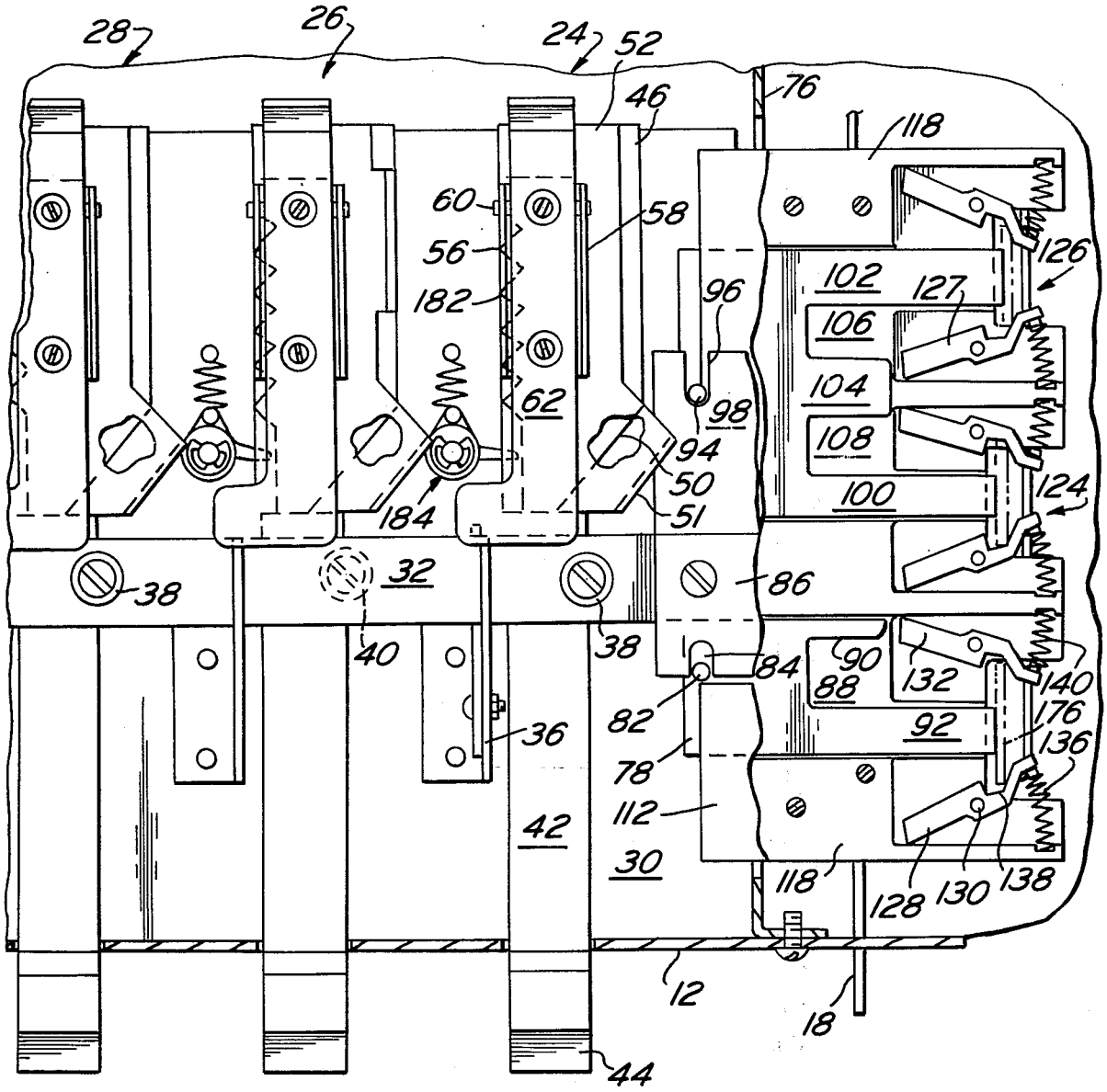
FIG. 4 is a view taken along the line 4—4 in FIG. 3.
Figure 5:
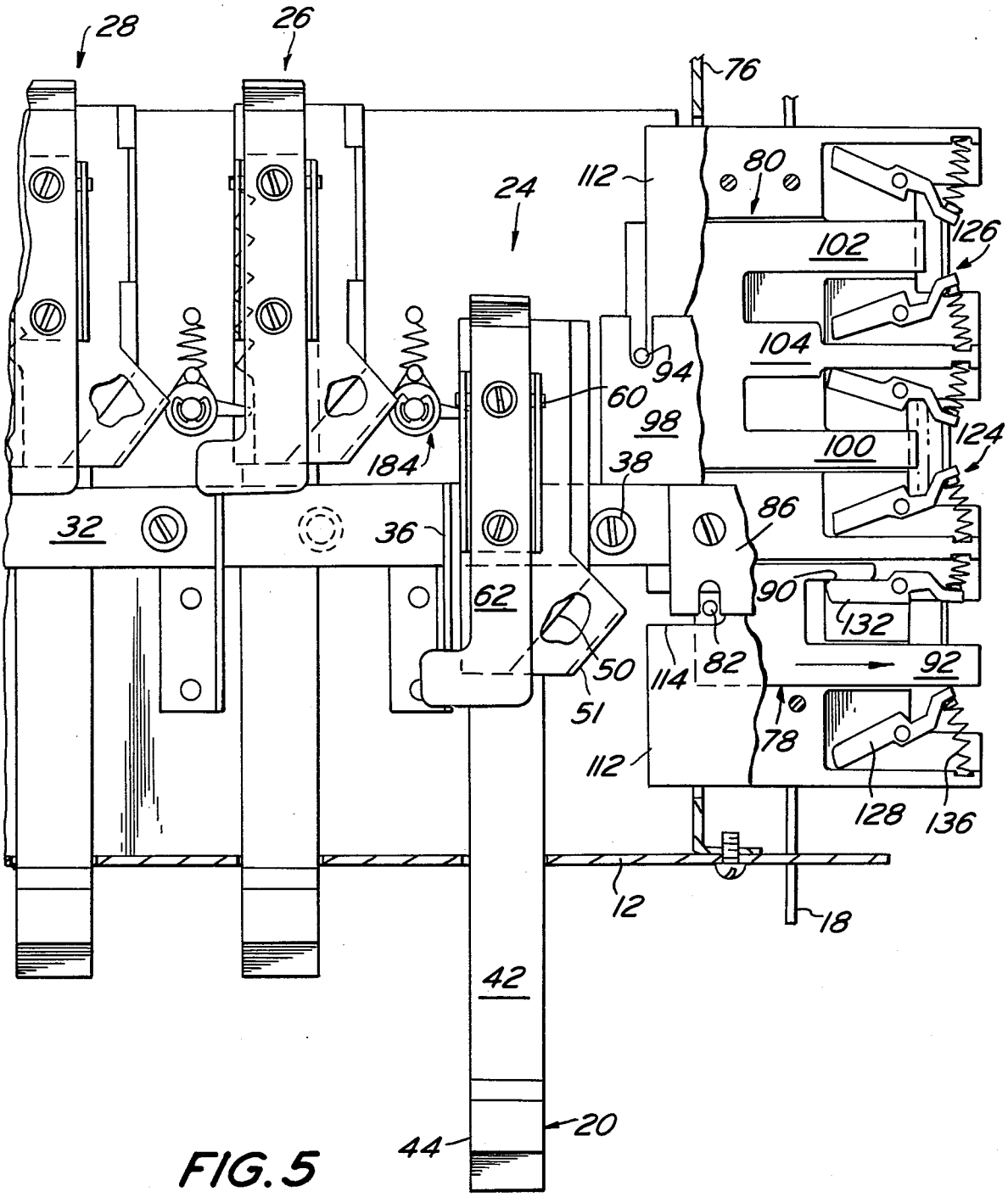
FIG. 5 is a view similar to FIG. 4 but ilustrating the components in the positions they occupy after a dispensing action.

Associated with each actuator 20, there is provided a dispensing device. Referring to FIGS. 4 and 5, there is illustrated three adjacent dispensing devices identified as 24, 26 and 28. The dispensing devices are identical except as will be made clear hereinafter. Hence, only device 24 will be described in detail. In FIG. 5, the actuator 20 associated with device 24 has been actuated to effect a dispensing action.

Figure 3:
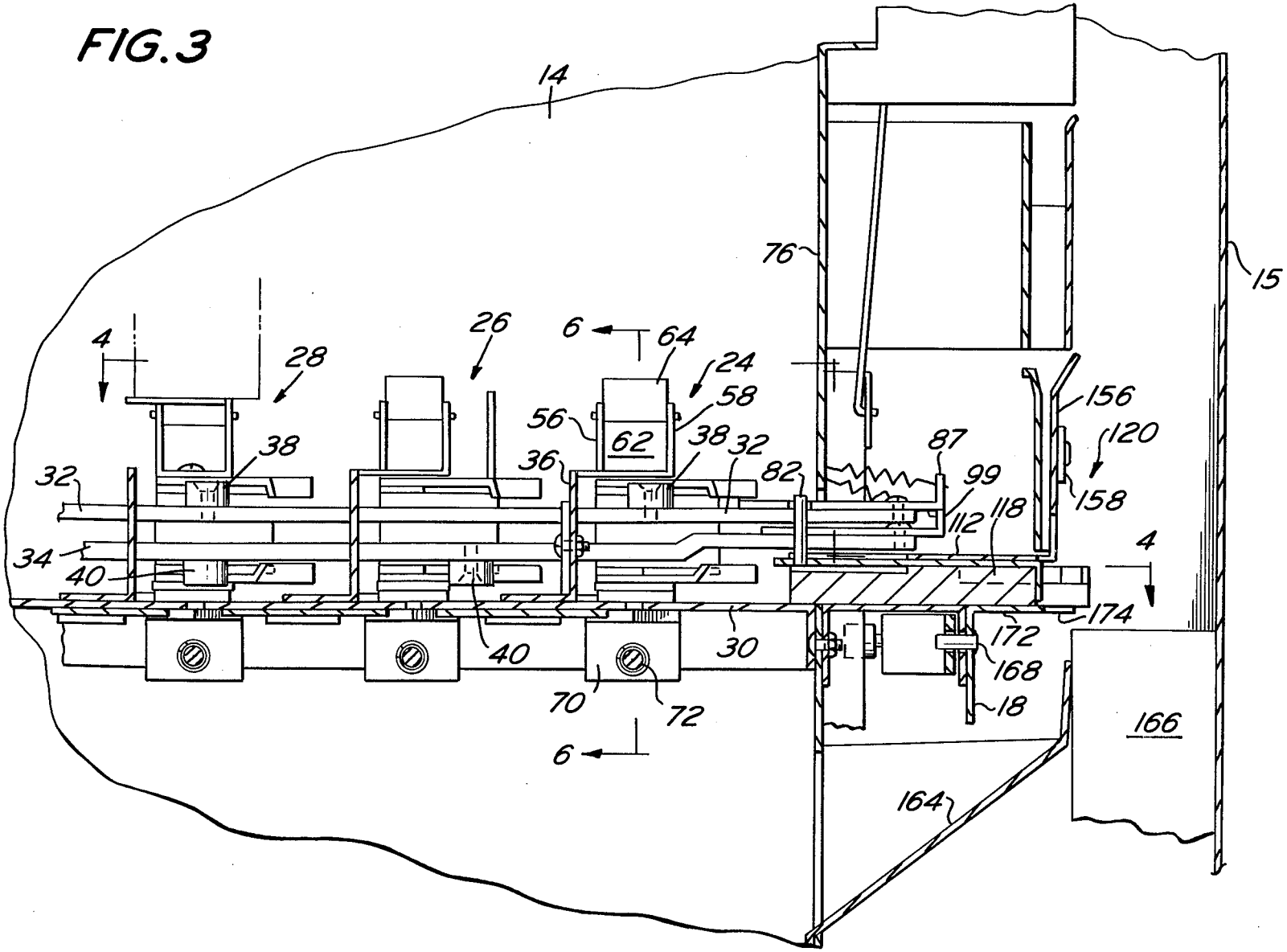
FIG. 3 is a sectional view taken along the line 3—3 in FIG. 2.

Referring to FIG. 3, the housing includes a horizontally disposed wall 30 which supports the dispensing devices 24–28. A bracket 36 is secured to the wall 30 between device 24 and the front wall 12 of the housing. Bracket 36 supports a first bar 32 and a second bar 34 for horizontal reciprocation in a direction parallel to wall 30. As shown more clearly in FIG. 6, bar 32 is disposed directly above bar 34.

An upstanding stud 38 is provided on bar 32 at spaced locations therealong. As shown in FIG. 4, a stud 38 is provided adjacent the dispensing devices 24 and 28. Depending studs 40 are secured to the lower surface of bar 34 at spaced locations therealong. As shown in FIGS. 3 and 4, a stud 40 is located adjacent devices 26 and 28.

Each actuator 20 includes a knob 44 connected to one end of a plunger 42. Plunger 42 extends through a slot in front wall 12 and is disposed above the elevation of wall 30. The end of plunger 42 remote from the knob 44 is secured to a plunger mount 46. The plunger mount 46 is preferably U-shaped with its lower leg being secured to the plunger 42 by a plurality of fasteners 48. The lower leg of plunger mount 46 is at the same elevation as stud 40. The upper leg of the plunger mount 46 is at the same elevation as the stud 38. Each leg of the plunger mount 46 is provided with a cam surface 50. As will be seen from a comparison of FIGS. 4 and 5, movement of the plunger mount 46 results in cam surface 50 contacting stud 38 and shifting the first bar 32 from left to right.

An upper plate 52, having a cam surface 51, is secured to the upper leg of the plunger mount 46. A lower plate 54, having a similar cam surface 51, is secured to the lower leg of the plunger mount 46. See FIG. 4. Upstanding brackets 56 and 58 are secured to the upper plate 52. A transverse pin 60 rotatably supports a lever arm 62 between the brackets 56 and 58. Arm 62 has an upstanding flange 64 at one end. The other end of arm 62 is juxtaposed to shoulder 66 on the bracket 36. See FIG. 6.

Directly beneath the plunger 42, the wall 30 is provided with an elongated slot. The slot associated with device 24 is designated 68. See FIG. 6. The fasteners 48 extend through the slot 68, are connected to a bracket 70 below the wall 30, and guide the device 24. A spring 74 extends around guide rod 72 and biases the bracket 70 from left to right in FIG. 6.

Thus, the device 24 is moved toward the wall 12 by pulling on the knob 44. Slot 66 guides the device 24 as it moves toward wall 12 and compresses spring 74. when the knob is released, spring 74 expands and returns the device 24 to the position shown in FIG. 6. Such movement of the device 24 from right to left in FIG. 6 can only occur if the lever arm 62 is in the phantom position shown in FIG. 6. Otherwise, lever arm 62 abuts shoulder 66 and prevents movement of the device 24 from right to left in FIG. 6.

Internally of the housing, there is provided a vertical partition wall 76. See FIG. 3. To the left of partition 76 in FIG. 3, the chamber may be considered the dispensing chamber. The space between partition 76 and wall 15 may be considered the coin mechanism chamber. Partition 76 is provided with a opening so that components associated with the bars 32 and 34 may pass therethrough.

Figure 7:
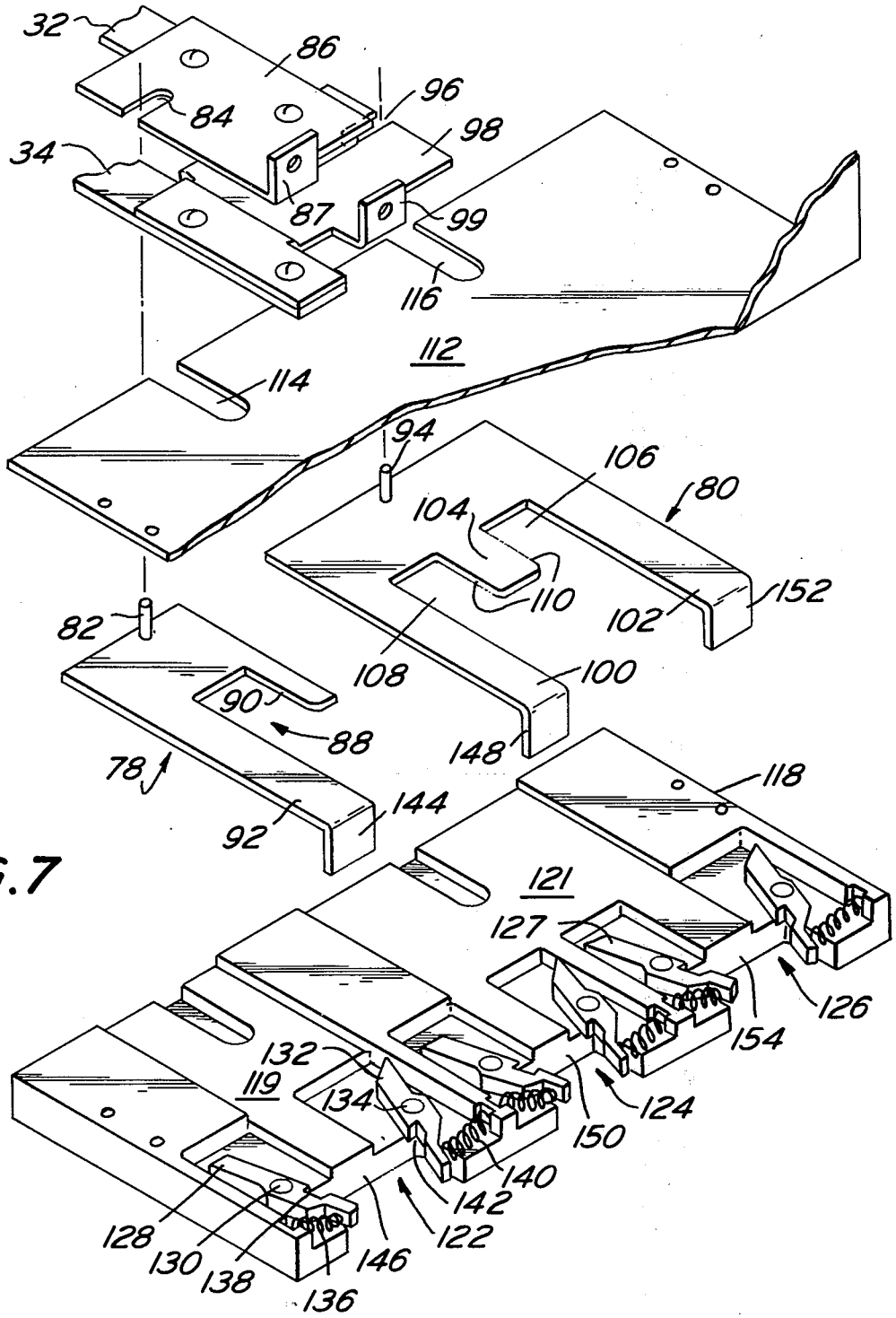
FIG. 7 is an exploded partial perspective view of components of the latch.

Referring to FIG. 7, for example, there is shown slides 78 and 80 disposed side by side. Slide 78 has a pin 82 which is received by notch 84 on bracket 86. Bracket 86 is removably secured to the first bar 32 and has an upwardly extending flange 87. Flange 87 is connected to the partition 76 by a spring which biases the bar 32 from right to left in FIG. 3.

As shown more clearly in FIG. 7, the slide 78 is provided with a recess 88. Recess 88 is defined in part by surface 90 which is parallel to the bar 32. Slide 78 includes a projection 92 which is spaced from and parallel to the bar 32. The purpose of projection 92 will be made clear hereinafter.

The slide 80 is disposed alongside slide 78. Slide 80 includes a pin 94 which extends through and is received by a notch 96 on bracket 98. Bracket 98 is removably attached to the bar 34. Bracket 98 is wider than bracket 86 and is disposed at least in part directly below bracket 86. Bracket 98 has an upstanding flange 99 which is connected to partition 76 by a spring, thereby biasing the bar 34 from right to left in FIG. 3.

The slide 80 includes a pair of parallel projections 100 and 102 which are parallel to projection 92. A projection 104 is provided between the projections 100 and 102 thereby cooperating therewith to define a pair of recesses 106 and 108. Each of the recesses 106 and 108 is partially defined by parallel surfaces 110 on the projection 104. The surfaces 90 and 110 are parallel to the direction of movement of the slides 78 and 80 and their associated bars 32 and 34.

Within the coin mechanism chamber, there is provided a partition wall 112. The partition wall 112 lies in a plane above the wall 30. The slides 78 and 80 are below the partition wall 112 while the bars 32 and 34 together with their associated brackets 86 and 98 are above the partition wall 112. Partition wall 112 is provided with a notch 114 through which the pin 82 extends and a notch 116 through which the pin 94 extends. See Fig. 7.

As shown more clearly in FIG. 7, there is provided a latch mount preferably constructed in the form of a casting and designated as 118. The latch mount 118 is part of the coin mechanism designated generally as 120. Latch mount 118 has a recessed surface 119 for reciprocably supporting the slide 78 and a similar recessed surface 121 for reciprocably supporting the slide 80.

The latch mount 118 is provided with a plurality of sets of latching fingers designated 122, 124 and 126. The sets of latching fingers are identical. Hence, only set 122 will be described in detail.

The set of latching fingers 122 includes latching fingers 128 and 132 rotatably supported on a latch mount 118 at an elevation which is slightly above and slightly below the elevation of the recessed surface 119. Finger 128 pivots about pin 130. Finger 132 pivots about pin 134.

A portion of finger 128 to one side of pin 130 is provided with a notch 138 biased toward the finger 132 by spring 136. Finger 132 likewise has a notch 142 biased toward notch 138 by spring 140. The springs 136 and 140 are sufficiently light whereby movement of a coin, such as a 25 cent piece, out of the notches 138 and 142 will bias the fingers 128 and 132 from a converging position to a position wherein the fingers are generally parallel to one another whereby finger 132 will be aligned with recess 88 on slide 78.

The latch mount 118 is notched adjacent each of the sets 122, 124 and 126. Adjacent set 122, the latch mount 118 is provided with a surface 146 adapted to act as a limit stop for the downwardly extending tab 144 on the projection 92. Surface 150 adjacent set 124 acts as a limit stop for the downwardly projecting tab 148 on projection 100. Surface 154 adjacent set 126 acts as a limit stop for the downwardly projecting tab 152 on the projection 102.

A coin guide 156 is provided above the latch mount 118 and below a conventional coin sorter 157 which will direct coins toward one of the sets of latching fingers depending on the size of the coin. For example, all quarters may be directed to set 122, all dimes may be directed to set 124, and all nickels may be directed to set 126.

A lock out lever 158 is pivotably supported in any convenient location such as on the coin guide 156. The lock out lever pivots about pin 160 and terminates at its free end in a projection 162. The lever 158 may be manually moved from the inoperative position shown in FIG. 2 to the operative position shown in phantom in FIG. 2 whereby the finger 127 of set 126 is rendered inoperative so that it does not block movement of slide 80. Thus, lever 158 provides for selectivity of the coins necessary to effect a particular dispensing action. For example, in the inoperative position of lever 158, a coin is required in the notches between each of the fingers of sets 124 and 126 in order to permit a dispensing action to occur. When the lever 158 is in the phantom position shown in FIG. 2, a coin is only required in the notches of the fingers of set 124 in order to permit a dispensing action to occur by way of slide 80.

As shown in FIG. 3, a coin return chute 164 is provided below the latch mount 118. Chute 164 directs coins to the recess 16. Adjacent to chute 164, there is provided a receptacle 166 for receiving coins when a dispensing action has taken place. Thus, coins directed through chute 164 are returned to the customer whereas coins directed into receptacle 166 are retained within the vending machine 10.

The coin return member 18 extends through the front wall 12 of the housing and is reciprocably supported by pins 168 which extend through guide slots 170 on a downwardly extending flange of a horizontally disposed partition in the coin mechanism chamber. See FIGS. 2 and 3. The coin return member 18 has a horizontally disposed flange 172 provided with apertures or notches 174. Only a portion of each aperture or notch 174 is directly below the coins when the coins are supported by flange 172 and embraced by the fingers of the sets 122, 124 and 126. Movement of the coin return member 18 by the customer from right to left in FIG. 2 results in direct alignment of each aperture or notch 174 in flange 172 with one of the coins whereby the coins fall downwardly through the chute 164. Each aperture or notch 174 on the flange 172 is offset with respect to the coins 176, 178 and 180 when member 18 is in its normal position whereby the coins may not fall directly into the chute 164. See FIG. 2.

The plungers 42 may be provided with teeth 182 along a side thereof for cooperation with a ratchet 184 in a conventional manner. The teeth and ratchet requires the knob 44 to be moved through an entire stroke whereby a dispensing action occurs and a coin is received by the receptacle 164. Thus, the knob 44 may not be pulled partially through its stroke in a manner whereby dispensing will occur but the coin permitted to be returned to the customer.

The operation of the vending machine 10 is as follows.

Coins introduced into the machine 10 will be sorted by the conventional coin sorter 157 and directed to the coin guide 156 in the proper orientation as described above. For purposes of illustration, it will be assumed that coin 176 is a 25 cent piece, coin 178 is a dime and coin 180 is a nickel. Further, assume each article of the column of articles 22 associated with device 28 have a value of 40 cents.

Figure 6:
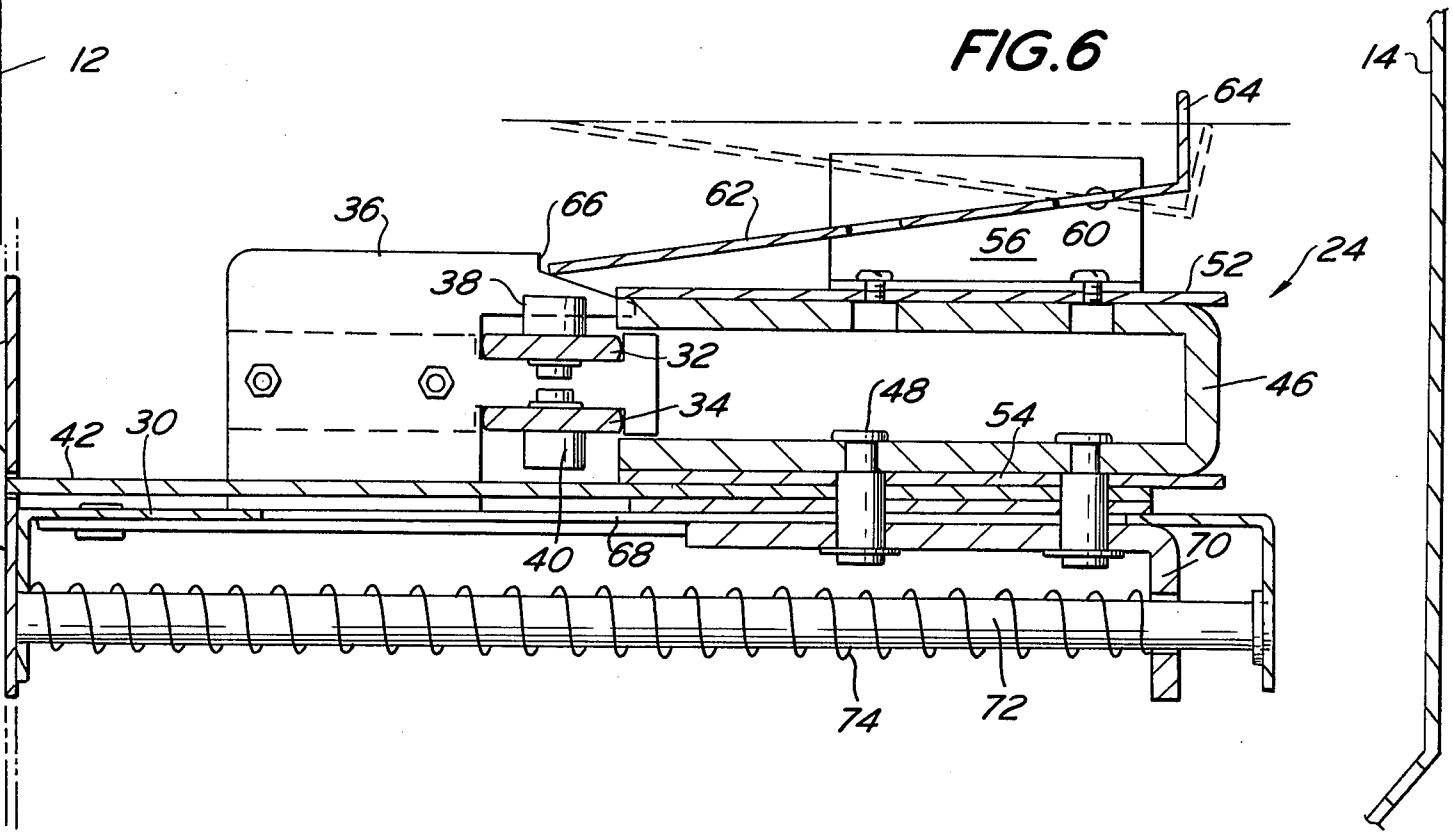
FIG. 6 is a sectional view taken along the line 6—6 in FIG. 3.

The flange 64 on arm 62 engages the bottom surface on the lowermost element in the column of articles to be dispensed whereby arm 62 is pivoted to the phantom position shown in FIG. 6. In the absence of arm 62 pivoting to the phantom position, the left hand end of arm 62 will engage shoulder 66 and it will not be possible to pull the knob 44 outwardly to effect a dispensing action.

When the knob 44 associated with device 28 is pulled outwardly, the cam surface 50 on the upper plate 52 contacts stud 38 and shifts the bar 32 to the right in FIG. 3. At the same time, the cam surface 50 on the lower plate 54 contacts the stud 40 and shifts the plate 34 to the right in FIG. 3. Such movement causes the slides 78 and 80 to move from left to right in FIGS. 3 and 4. As the slides 78 and 80 move, projection 92 contacts the coin 176 and pushes it into the receptacle 166. Likewise, projection 100 pushes the coin 178 into receptacle 166 and projection 102 pushes the coin 180 into receptacle 166.

As the coin 176 is pushed by the projection 92, it spreads the fingers 128 and 132 apart so as to be substantially parallel to one another whereby finger 132 is aligned with and enters the recess 88. As soon as the coin 176 moves toward the receptacle 166, spring 140 expands whereby finger 132 rides along surface 90.

In a similar manner coin 178 spreads apart the fingers of set 124 whereby one of said fingers enters the recess 108. In a similar manner, coin 180 spreads apart the fingers of set 126 so that finger 127 enters the recess 106. If one of the coins were missing, such as coin 180, slide 80 would contact an end of finger 127 and stop thereby preventing the plunger associated with device 28 from moving sufficiently forward toward wall 12 whereby a dispensing action could occur. The ratchet would automatically jam the teeth on the plunger.

If all of the required coins are present, and all are caused to enter the receptacle 166 by spreading apart their associated fingers, the slides 78 and 80 will move through a full stroke. As a result thereof, the plunger 42 will move through a full stroke whereby the teeth on the plunger will move past the ratchet associated therewith. Thereafter, the return spring on the plunger will return the device 28 to its original position. On the return stroke, the flange 64 on the lever arm 62 will push the lowermost article to be dispensed toward the wall 14 whereby it will fall through a chute to the recess 16.

The bars 32 and 34 will then be permitted to return to their original position under the bias of the springs attached to the flanges 87 and 99. In addition, the stud 38 will be cammed to the left in FIG. 4 by the cam surface 51 on the upper plate 52 while the stud 40 on the bar 34 will be likewise cammed by contact with the cam surface 51 on the lower plate 54. Thus, the camming action of the cam surfaces 51 assures that the bars 32 and 34 will not be jammed in a dispensing position.

Since the dispensing device 24 only has a stud 38 on its upper surface, with no associated stud 40 on the bar 34, see FIG. 3, only coin 176 is necessary to effect a dispensing action from the column of articles 22 associated with device 24. If the dispensing device 26 is activated as described above, only coins 178 and 180 are necessary in order to effect a dispensing action.

Figure 2:
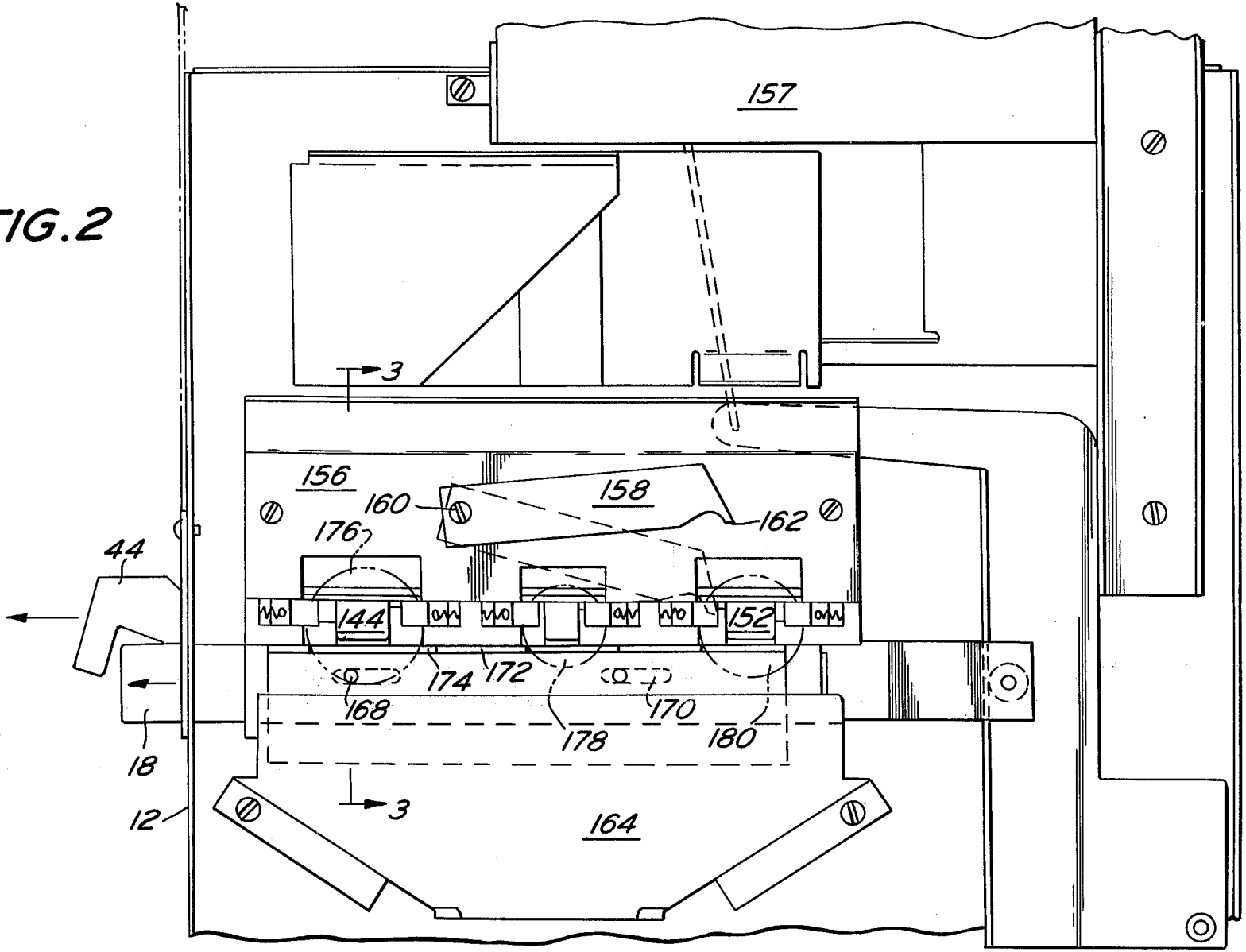
FIG. 2 is a sectional view taken along the line 2—2 in FIG. 1 and on an enlarged scale.

The finger 127 may be rendered inoperative by moving the lock out lever 158 to the phantom position shown in FIG. 2. If this is done, only coin 178 is needed to effect a dispensing action by device 26. Alternatively, only coins 176 and 178 are needed to effect a dispensing action by device 28. Thus, the vending machine 10 of the present invention facilitates dispensing articles which require 10 cents (coin 178), 15 cents (coins 178, 180), 25 cents (coin 176), 35 cents (coins 176, 178), and 40 cents (coins 176–180).

If a customer desired to receive his money back after inserting the money into the vending machine 10, the customer need only pull on the coin return member 18. A notch or aperture 174 on flange 172 will then be aligned with each of the coins whereby they may fall directly down into chute 164.

Thus, it will be seen that the vending machine of the present invention uses the coin to unlatch a portion of the dispensing device, has the ability to lock out one of the sets of latches, etc. It is within the scope of the present invention to utilize only a single bar 32 and its associated slide 78. Further, it would be within the scope of the present invention to use a slide for bar 34 which is identical with slide 78 or provide each of the bars 32 and 34 with a slide 80.

The present invention may be embodied in other specific forms without departing from the spirit or essential attributes thereof and, accordingly, reference should be made to the appended claims, rather than to the foregoing specification as indicating the scope of the invention.

It is claimed:

1. A vending machine comprising a housing, a movable actuator on said housing, a dispensing device coupled to said actuator, said dispensing device including a plunger mount and a bar member, said plunger mount being connected to said actuator to move said plunger mount in a first horizontal direction, said bar member being mounted for movement in a second horizontal direction generally perpendicular to said first direction, cam means associated with said plunger mount and said bar member so that movement of said plunger mount in said first direction causes movement of said bar member in said second direction, a movable latch biased to a first position wherein the latch blocks the movement of said bar member, said latch having a second position wherein it does not block the movement of said bar member, said latch being movable from said first position to said second position by a coin lying in a vertical plane with its side face generally perpendicular to the direction of movement of said bar member and aligned with said bar member, and means associated with said bar member for contacting the side face of a coin temporarily holding said latch in its second position and dislodging the coin as said device performs a dispensing action.

2. A vending machine in accordance with claim 1 wherein said latch includes a pair of latching fingers, said means including a portion of said device which moves between the latching fingers and contact a coin when said device performs a dispensing action.

3. A vending machine in accordance with claim 2 wherein said fingers are mounted for pivotable movement about vertical axes, and said dispensing device portion including a bar member mounted for reciprocation in a horizontal direction toward and away from the fingers.

4. A vending machine in accordance with claim 1 wherein said latch includes a plurality of sets of fingers, each set of fingers including a pair of fingers biased toward each other, said pair of fingers being adapted to embrace a coin which moves the fingers of a pair away from each other where the coin is forced out of a position between said fingers.

5. A vending machine in accordance with claim 1 wherein said latch includes a plurality of sets of fingers, and means for selectively locking at least one finger of a set of fingers in an inoperative position wherein it does not block said device.

6. A device in accordance with claim 1 wherein said dispensing device further includes a pair of projections on said bar member, said latch including a pair of fingers associated with each projection, each projection being orientated to move between the fingers of a pair of fingers when said device performs a dispensing action.

7. A vending machine in accordance with claim 1 wherein said dispensing device further includes a second bar member, said bar members being disposed one above the other, said plunger mount being connected to said actuator for movement in a first horizontal direction toward and away from said bar members, said bar members being mounted for movement in a second horizontal direction which is generally perpendicular to said first direction, and cam means associated with said plunger mount and bar members so that movement of said plunger mount in said first direction causes movement of at least one of the bar members in said second direction, and said latch when in its first position opposes movement of each bar member.

8. An article of manufacture for use in a vending machine comprising a bar member adapted to be moved horizontally in a direction corresponding generally to its longitudinal axis during a dispensing action, an actuator coupled to said bar member to provide a force transverse to said direction, at least two discrete cam means at spaced locations on said bar member for converting said transverse force of said actuator into movement of said member in said direction, a latch comprising a pair of fingers pivotably mountable about a vertical axis and biased to a first position wherein at least one of said fingers is positioned to block movement of said bar member, at least one of said fingers being pivotable to a second position wherein said bar member may move between said fingers, and a projection on said bar member positioned to move between the fingers to contact a side face of a coin held by the fingers to thereby pivot at least one finger about said vertical axis to its second position while the coin is propelled by said projection toward a receptacle.

9. An article of manufacture in accordance with claim 8 wherein said latch includes two sets of fingers, said bar member having two projections with each projection being adapted to move between one of said sets of fingers.

10. A vending machine comprising a housing, means within the housing for selectively dispensing from a plurality of sources, said means including a plurality of actuators partially extending out of said housing, said actuators guide for movement in a first horizontal direction, a bar-like member which is moved in a second horizontal direction corresponding generally to its longitudinal axis during the dispensing action by cam means associated with one of said actuators and said bar-like member when said one actuator is moved in said first direction, said second direction being generally perpendicular to said first direction, a latch means for said bar-like member, said latch means having a first position wherein movement of the bar-like member is blocked and a second position wherein said bar-like member is free to move in said second direction, means including a coin return member adjacent said latch means for supporting a coin, a chute in said housing below said latch means for receiving coins for return to a customer upon movement of said coin return member, a receptacle in said housing for receiving coins, said latch means having structure for supporting a coin in a vertical plane generally perpendicular to said second direction with a side face of the coin aligned with said bar-like member, said bar-like member being provided with a surface for engaging a side face of a coin held by said latch means to push the coin from said latch means to said receptacle and simultaneously move said latch means to its second position, said surface on said bar-like member being unable to effect movement of the latch means to its second position except by contact with a side face of a coin.

* * * * *

UNITED STATES PATENT OFFICE

CERTIFICATE OF CORRECTION

PATENT NO. : 3,948,380
DATED : April 6, 1976
INVENTOR(S) : Harry Galin

It is certified that error appears in the above-identified patent and that said Letters Patent are hereby corrected as shown below:

In Claim 2, line 4, for "contact" read--contacts--.

In Claim 10, line 5, for "guide" read--guided--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*